US007137851B2

(12) United States Patent
Xue et al.

(10) Patent No.: US 7,137,851 B2
(45) Date of Patent: Nov. 21, 2006

(54) ELECTRICAL CONNECTOR

(75) Inventors: Zhang Lan Xue, Kunsan (CN); ZiQiang Zhu, Kunsan (CN); Jinkui Hu, Kunsan (CN); Guohua Zhang, Kunsan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/973,953

(22) Filed: Oct. 25, 2004

(65) Prior Publication Data

US 2005/0095908 A1 May 5, 2005

(30) Foreign Application Priority Data

Oct. 31, 2003 (CN) ..... 2003 2 0110675

(51) Int. Cl.
*H01R 24/04* (2006.01)

(52) U.S. Cl. ..... 439/668; 439/188; 200/51.09

(58) Field of Classification Search ..... 439/188, 439/541.5, 668; 200/51.09
See application file for complete search history.

(56) References Cited

U.S. PATENT DOCUMENTS 4,426,558 A 1/1984 Tanaka et al.
4,937,404 A 6/1990 Kitagawa
5,893,767 A 4/1999 Broschard, III
6,062,885 A 5/2000 White
6,227,905 B1 5/2001 Tsai et al.
6,234,833 B1 5/2001 Tsai et al.
6,234,834 B1 5/2001 Tsai et al.
6,270,380 B1 8/2001 Shichida et al.
6,575,793 B1 * 6/2003 Li et al. ..... 439/668
6,666,716 B1 * 12/2003 Chien-Chung ..... 439/541.5
6,887,099 B1 * 5/2005 Tung ..... 439/541.5
6,921,291 B1 * 7/2005 Shih ..... 439/541.5
2003/0211776 A1 11/2003 Lin

* cited by examiner

*Primary Examiner*—Briggitte Hammond
*Assistant Examiner*—X. Chung-Trans
(74) *Attorney, Agent, or Firm*—Wei Te Chung

(57) ABSTRACT

A stacked electrical connector has an insulative housing (1), a plurality of signal contacts (23, 26) and a pair of contacts (24, 27, 25, 28) retained in the housing. The housing defines a mounting surface (19) for mounting on a printed circuit board and a receiving space (12) for receiving a mating plug (9). The switch contact includes a base portion retained in the housing and a spring arm extending from the base portion. An insulative separator (245) is formed on one spring arm and projects into the receiving space. The separator is moveable in a plane vertical to the mounting surface. When the mating plug inserts into the receiving space, the separator rotates and drives one switch contact to connect with the other switch contact.

22 Claims, 9 Drawing Sheets

ELECTRICAL CONNECTOR

BACKGROUND OF THE INVENTION

1. Field of the Invention

The present invention relates to an electrical connector, and particularly to a stacked audio jack connector.

2. Description of Prior Arts

With the ever-increasing miniaturization of computer and other electronic equipment, it becomes increasingly difficult to design electrical circuitry for connector thereof. One area of such difficulty is electrical switches or switch assemblies. An electrical switch assembly may be used as a normally open switch with switch contacts designed to be closed upon actuating the switch, or the switch assembly may be a normally closed switch with the contacts designed to be opened when the switch is actuated.

U.S. Pat. No. 4,937,404 discloses an audio jack connector comprising an insulative housing and an insulative separator inserted into the housing. The separator has a U-shaped base portion for receiving a mating plug and a pair of movable pieces extending forwardly from the base portion. Between the movable pieces and the side walls of the housing, leaf contact pieces and metal plate contact pieces are inserted thereinto. The plate contact pieces are adjacent to the leaf contact pieces. Each leaf contact piece is longer than the adjoining plate contact piece and projects out towards the plate contact, and the free end portion of each leaf contact piece makes contact with the free end portion of the corresponding movable piece. When no plug is inserted, each leaf contact piece resiliently contacts the corresponding plate contact piece. When a plug is inserted into this audio jack connector, the pair of movable contact pieces are displaced by the plug outwardly in opposite directions, with the result that the leaf contact pieces are displaced, disengaging their contact portions from the plate contact pieces. The separator, the leaf contact pieces and the plate contact pieces are designed as an electrical switch assembly of this audio jack connector. Furthermore, because of the resilient contact between the leaf contact pieces and the corresponding plate contact pieces, the electrical switch assembly of this audio jack connector is used as a normally closed switch.

However, this kind of audio jack connector cannot satisfy the requirement of ever-increasing miniaturization, because the separator thereof is complex and very large in a horizontal direction.

Hence, it is desirable to have an improved electrical connector to overcome the above-mentioned disadvantages of the prior art.

SUMMARY OF THE INVENTION

It is an object of the present invention to provide an electrical connector having a switch contact with an insulative separator disposed therewith.

Another object of this invention is to provide an electrical connector with normally opened switches.

In order to achieve the above-mentioned objects, a stacked electrical connector in accordance with the present invention has an insulative housing, a plurality of signal contacts and a pair of switch contacts retained in the housing. The housing defines a mounting surface for mounting on a printed circuit board and a receiving space for receiving a mating plug. The switch contact includes a base portion retained in the housing and a spring arm extending from the base portion. An insulative separator is formed on one spring arm and projects into the receiving space. The separator is moveable in a plane vertical to the mounting surface. When the mating plug inserts into the receiving space, the separator rotates and drives one switch contact to connect the other switch contact.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
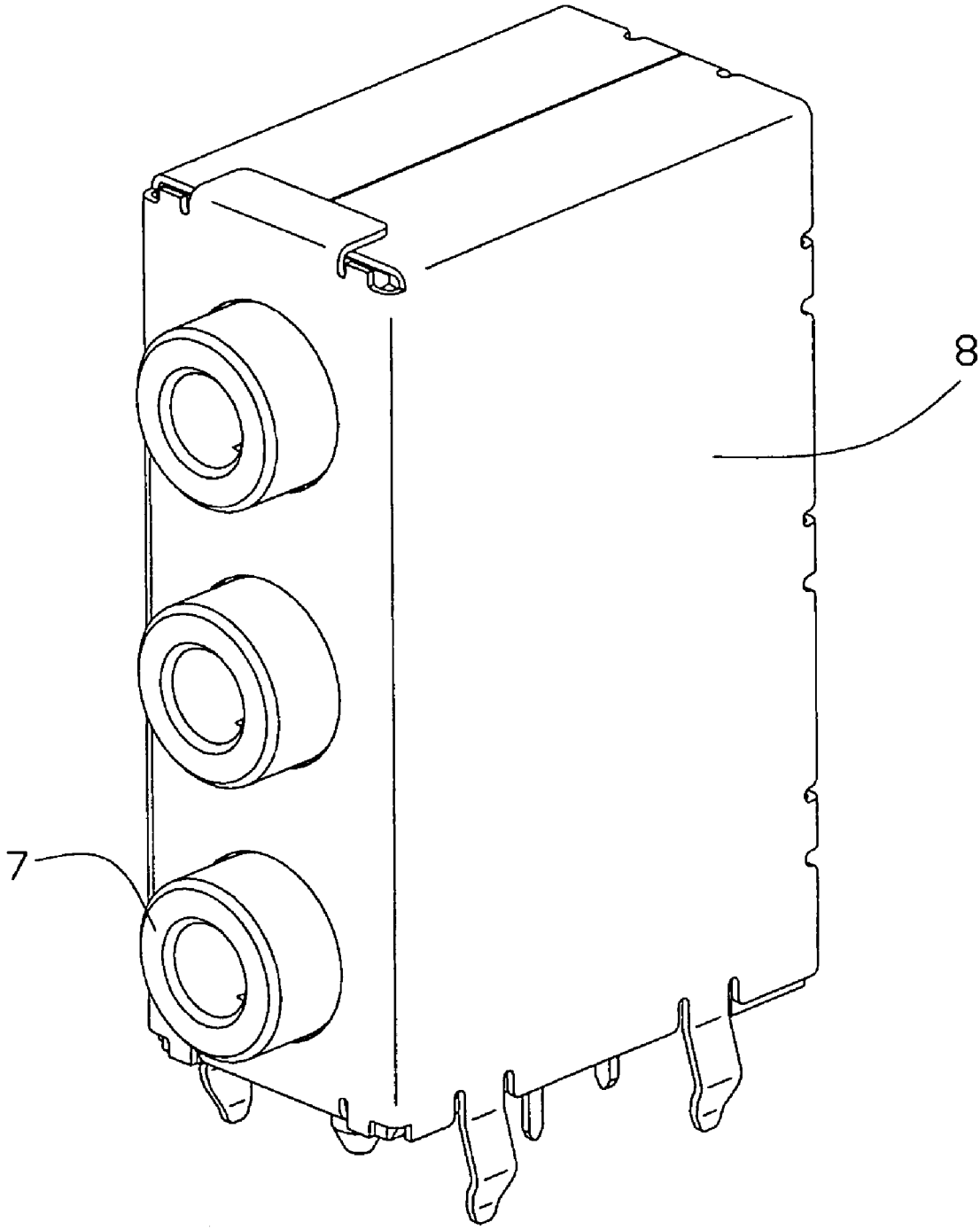
FIG. 1 is a perspective view of an electrical connector in accordance with the present invention.

Reference will now be made to the drawing figures to describe the present invention in detail.

Figure 2:
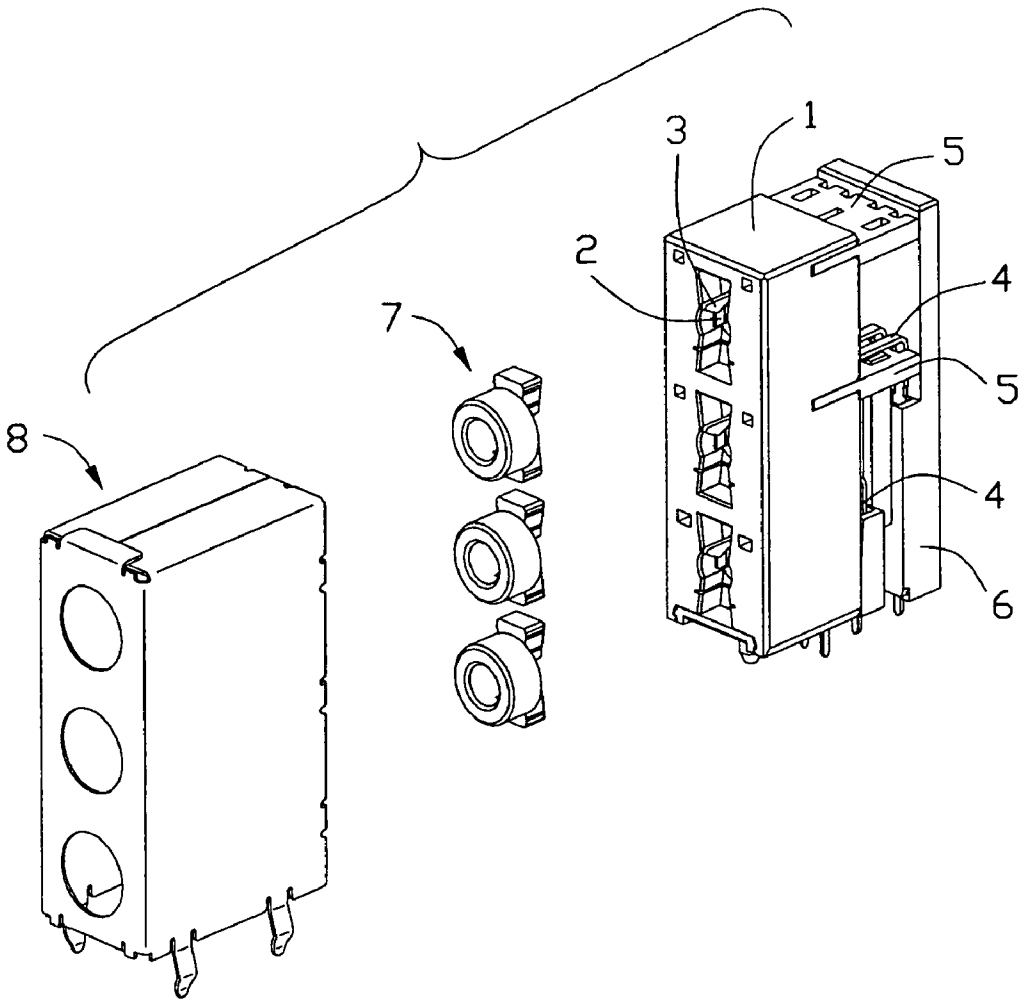
FIG. 2 is a partially exploded, perspective view of the connector shown in FIG. 1.
Figure 3:
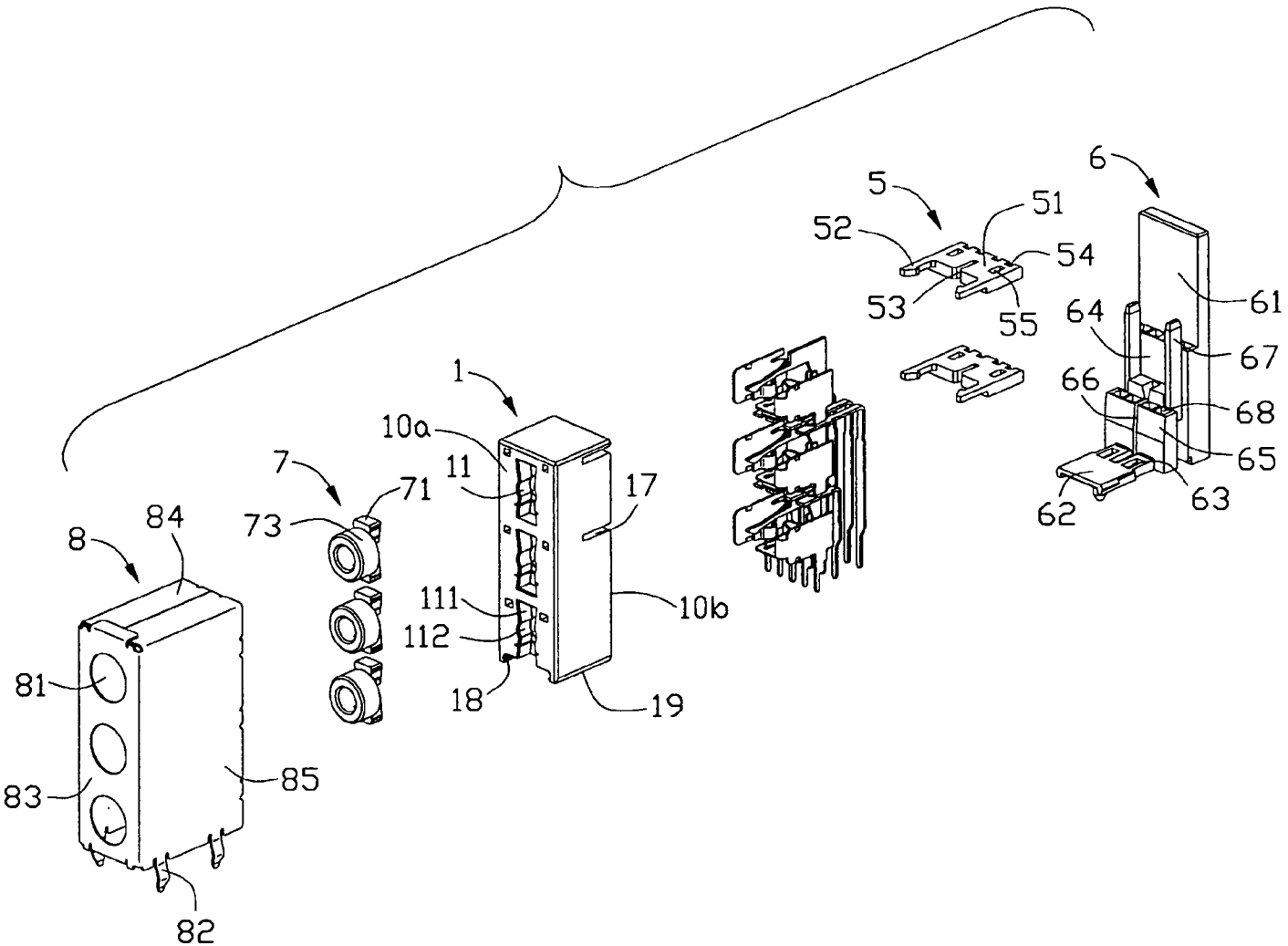
FIG. 3 is another partially exploded, perspective view of the connector shown in FIG. 2.
Figure 4:
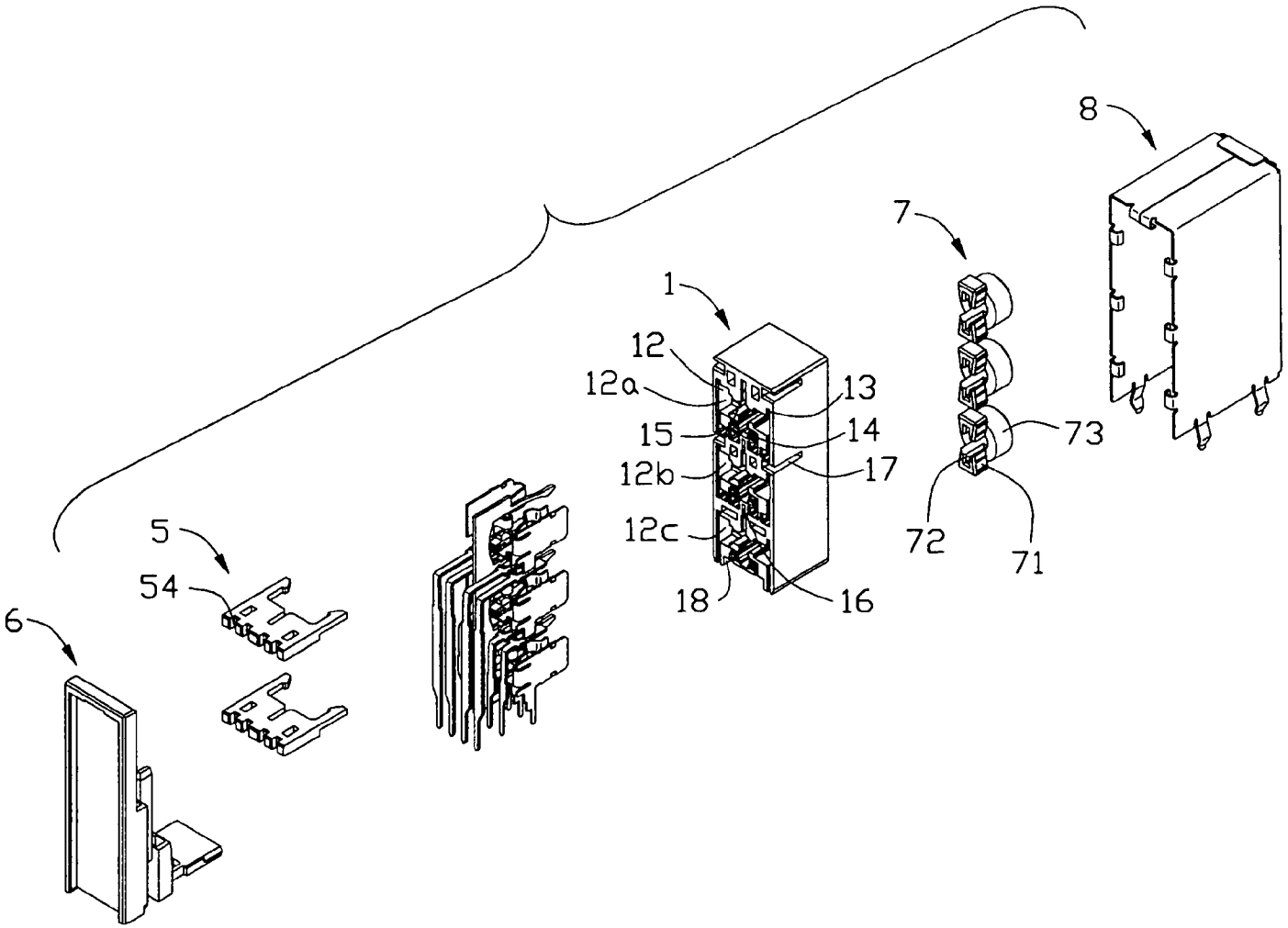
FIG. 4 is a view similar to FIG. 3 but taken from a different aspect.
Figure 5:
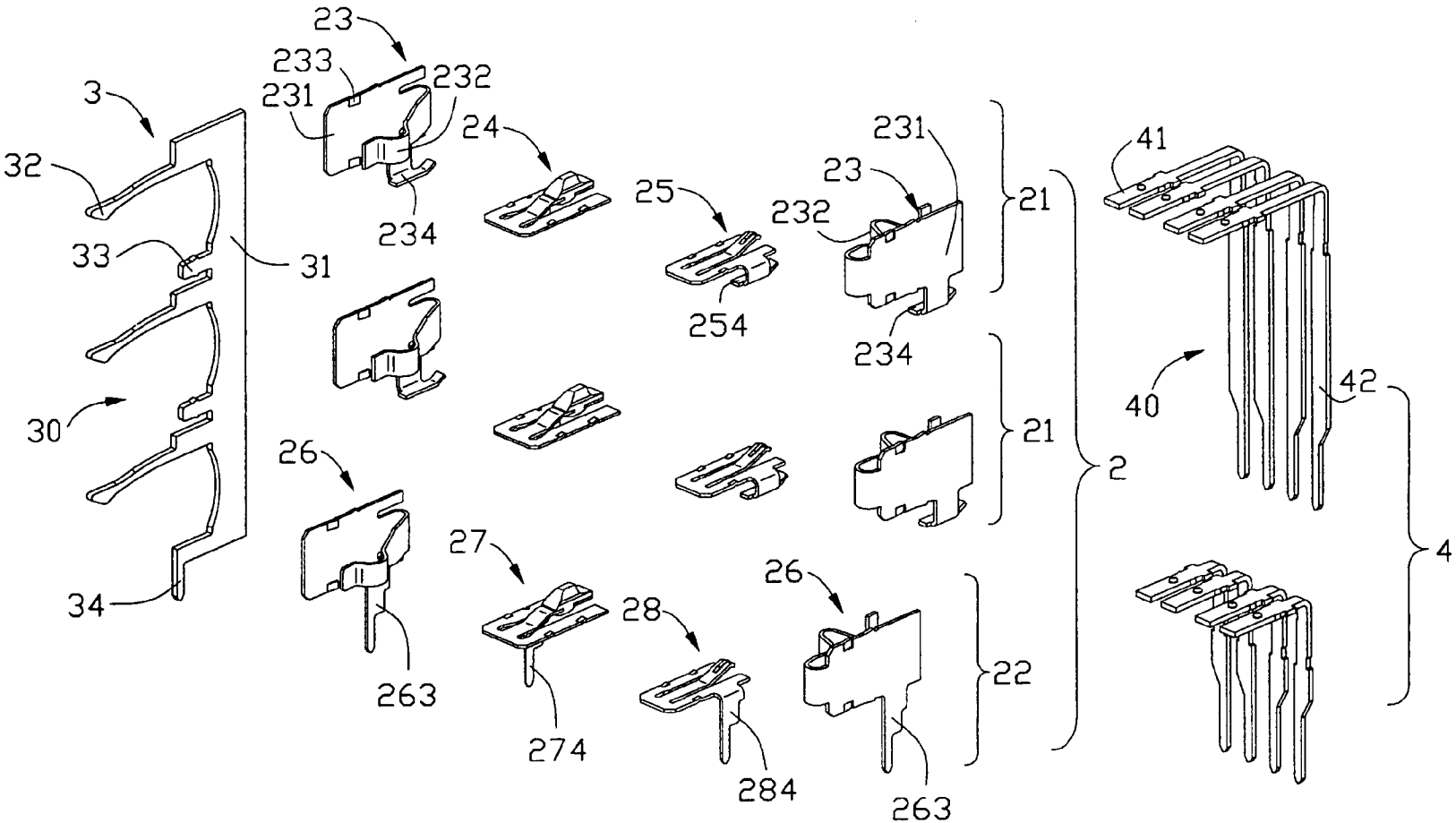
FIG. 5 is an exploded, perspective view of a terminal module shown in FIG. 3.
Figure 6:
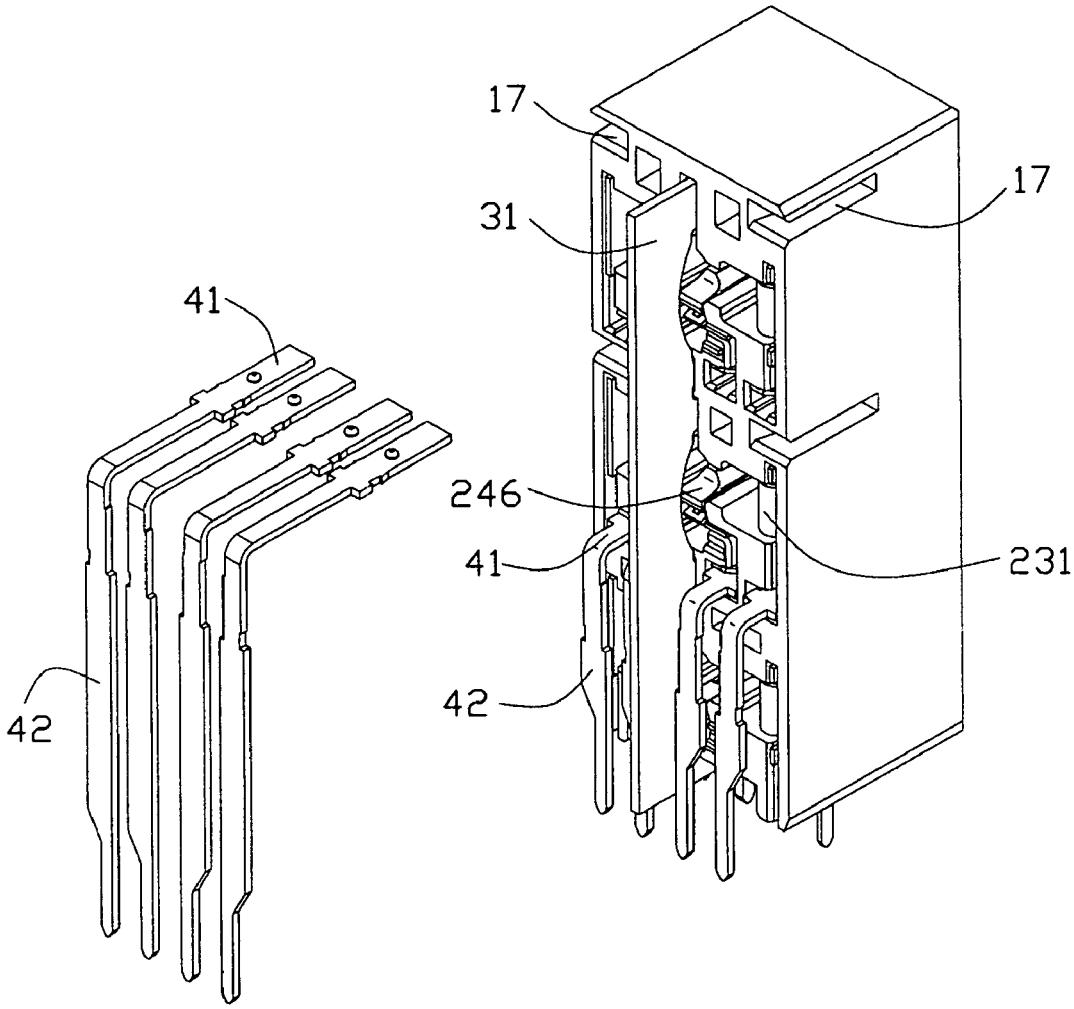
FIG. 6 is a partially assembled view of FIG. 4 with a spacer and a metal shield of the electrical connector removed for simplicity.

With reference to FIGS. 1 and 2 in conjunction with FIGS. 3 to 5, an electrical connector in accordance with the present invention is a stacked audio socket connector for mounting on a printed circuit board (not show) and comprises an insulative housing 1, a terminal module comprising a first terminal group 2, a second terminal group 3 and a third terminal group 4 respectively received in the insulative housing 1, a spacer 6, a plurality of retaining blocks 5, a plurality of mating ports 7 for guiding a mating plug 9 (FIGS. 7 and 8) and a metal shield 8.

Referring to FIGS. 3 and 4, the insulative housing 1 is generally in a rectangular shape. The housing 1 comprises a first face 10*a*, a second face 10*b* and a mounting surface 19 for mounting on the printed circuit board. Three cavities 11 are defined rearwardly from the first face 10*a* of the housing 1 and are stackedly arranged in an array along a direction vertical to the mounting surface 19. Each cavity 11 comprises a cylindrical hole 112 and a pair of trapeziform spaces 111 respectively communicating with the cylindrical hole 112. Three receiving spaces 12 are defined forwardly from the second face 10*b* of the housing 1 and respectively communicate with the cavities 11. The three receiving spaces 12 are respectively designated as 12*a*, 12*b* and 12*c*. A first slot 13, a second slot 14 and a third slot 15 are respectively defined forwardly from the second face 10*b* of the housing 1 and communicate a corresponding receiving space 12. A plurality of side apertures 17 is defined in opposite sides of the insulative housing 1. A plurality of slits 16 is defined between every two neighboring receiving spaces 12. A recess (not labeled) is defined in a mounting surface 19 of the insulative housing 1 to form a pair of latching edges 18 respectively adjacent to opposite sides of the housing 1.

Referring to FIG. 5, the first terminal group 2 comprises three terminal units, namely two first terminal units 21 and one second terminal unit 22. Each first terminal unit 21 consists of a pair of signal contacts 23, a first switch contact 24 and a second switch contact 25. Each signal contact 23 comprises a board portion 231, a folded contacting portion 232 extending from the board portion 231 towards the first face 10*a* of the housing, a plurality of tips 233 provided on the sides of the board portions 231 and a tail portion 234 extending vertically from bottom edge of the board portion 231.

Figure 8:
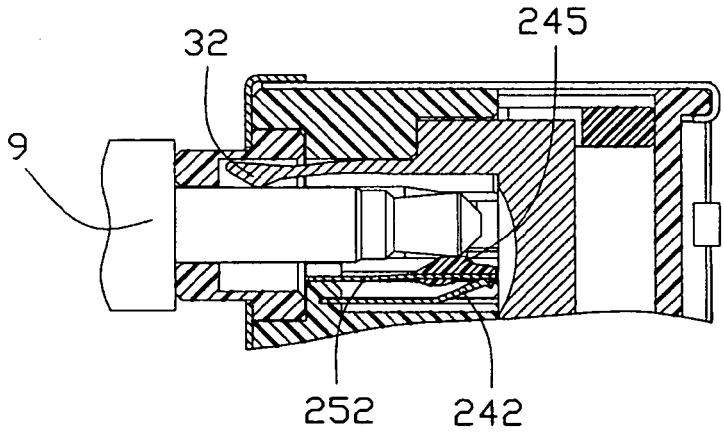
FIG. 8 is a view similar to FIG. 7 while showing the mating plug inserted into the connector.
Figure 9:
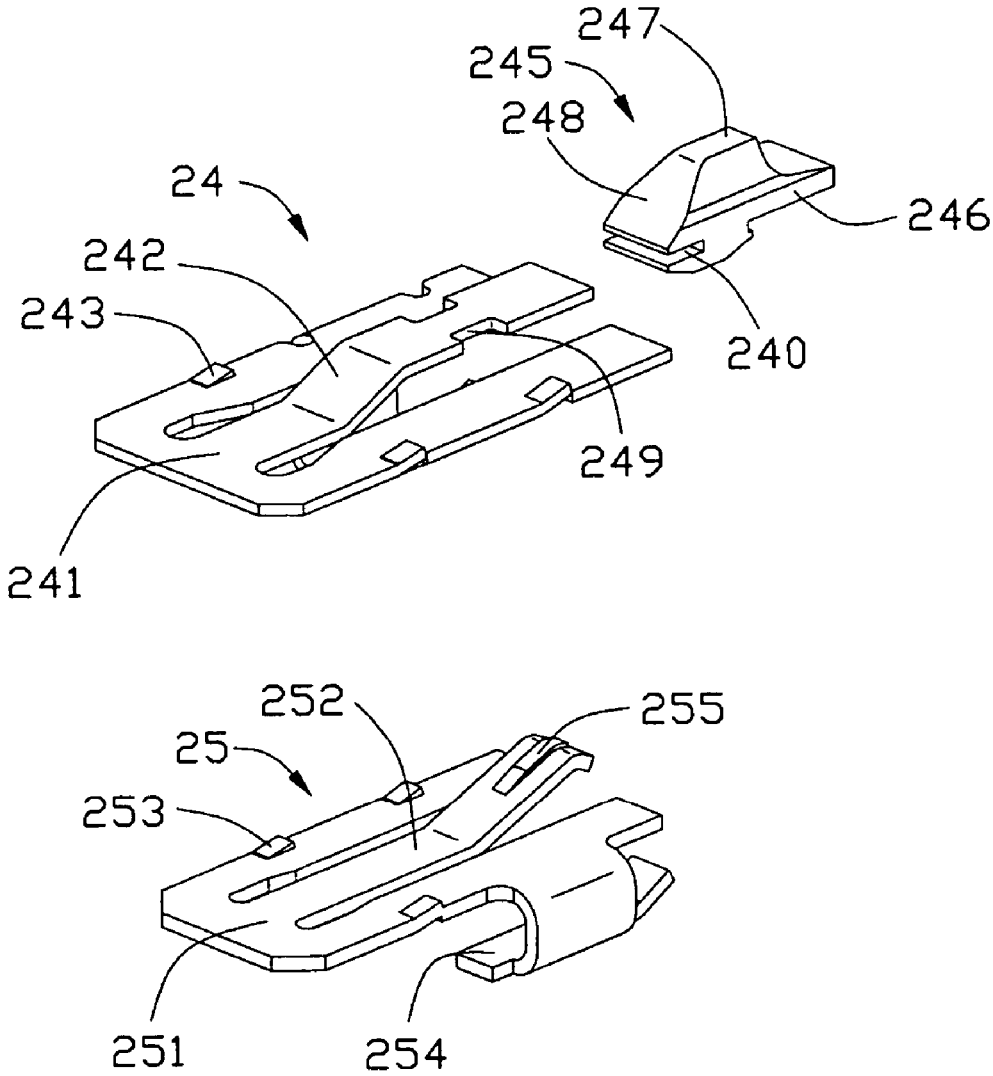
FIG. 9 is a perspective view of first, second switch contacts and a separator of the electrical connector.
Figure 10:
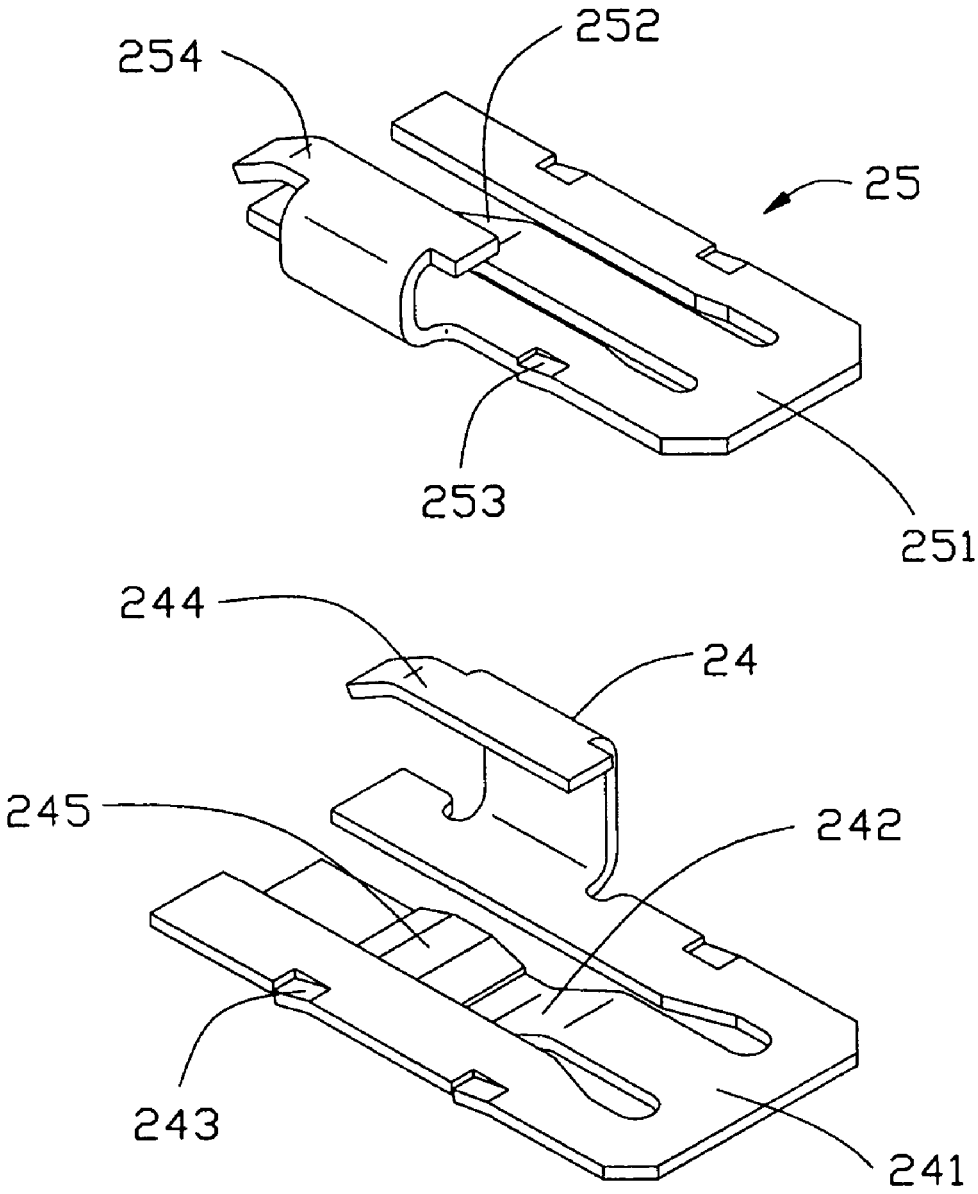
FIG. 10 is a perspective view of the first and second switch contacts in FIG. 9 but taken from a different aspect.

Further referring to FIGS. 9 and 10, the first switch contact 24 comprises a U-shaped first base portion 241 retained in the housing 1, a first spring arm 242 extending upwardly and rearwardly from the middle of the first base portion 241, a plurality of tips 243 provided on the sides of the first base portion 241 and a tail portion 244 extending vertically from bottom edge of the first base portion 241. The first spring arm 242 defines a pair of openings 249 in opposite sides of the free end thereof, and an insulative separator 245 is assembled on the first spring arm 242. The separator 245 comprises a base 246, a mating section 247 projecting from the base 246 into the receiving space 12, a guiding face 248 slantways defined in the front of the base 246 along an insertion direction of a mating complementary plug (FIGS. 7, 8) and an engaging groove 240 for engaging with the openings 249 of the first spring arm 242. The second switch contact 25 comprises a U-shaped second base portion 251 retained in the housing 1, a second spring arm 252 extending rearwardly and upwardly from the middle of the second base portion 251, a plurality of tips 253 provided on the sides of the second base portion 251, and a tail portion 254 extending vertically from bottom edge of the second base portion 251. A projection 255 projects from the free end of the second spring arm 252 towards the receiving space 12.

The second terminal unit 22 has the substantially same structure as that of the first terminal unit 21 except that tail portions 263, 274, 284 thereof respectively extend straight downwardly from corresponding contacts 26, 27, 28.

Continuing to FIG. 5, the second terminal group 3 is a grounding contact 30 comprising a vertical body strip 31, three arms 32 horizontally extending forward from the body strip 31. The arms 32 are spaced apart and parallel to one another. A pair of protrusions 33 extends forwardly from the body strip 31 of the grounding contact 30, and adjacent to the top two arms 32, respectively. An insert leg 34 extends downwardly from the bottom arm 32 for soldering to the printed circuit board.

With reference to FIG. 5, the third terminal group 4 consists of two sets of transition contacts 40 having similar structures. Each transition contact 40 comprises a mating portion 41 and a terminating portion 42 bending at a right angle from the mating portion 41.

Now referring to FIGS. 2–4, each retaining block 5 comprises a body section 51 and a pair of retaining latches 52 extending forwardly from opposite sides of a front end of the body section 51. The body section 51 defines a through slit 53 in a middle portion of the front end thereof, and the through slit 53 aligns with the slits 16 of the insulative housing 1. A plurality of grooves 54 is defined in a rear end of the body section 51 and a pair of holes 55 is defined in opposite sides of the body section 51.

Continuing to FIGS. 2–4, the spacer 6 is generally step-shaped and comprises a vertical panel 61 and a base 62 extending forwardly from a bottom end of the panel 61. The vertical panel 61 comprises a first step 65 and a second step 64 higher than the first step 65. A plurality of vertical passages 68 respectively extends through the first and the second steps 65, 64. A pair of through slots 66 is respectively defined in center portions of the first and the second steps 65, 64. The base 62 defines a plurality of rectangular recesses 63 extending therethrough. The second step 164 also forms a pair of posts 67 extending upwardly therefrom.

Each mating port 7 comprises a cylindrical neck 73 and a pair of projections 71 extending oppositely from upper and lower edges of the neck 73. A passageway 72 is defined forwardly from a rear surface of the projection 71 and partially extends into the neck 73.

Referring to FIG. 1, the metal shield 8 is general in a rectangular shape and comprises a front wall 83, a top wall 84 and a pair of opposite side walls 85. Three holes 81 are defined in the front wall 83 and align with the mating ports 7, and a plurality of feet 82 extends downwardly from bottom edges of the pair of side walls 85.

Figure 7:
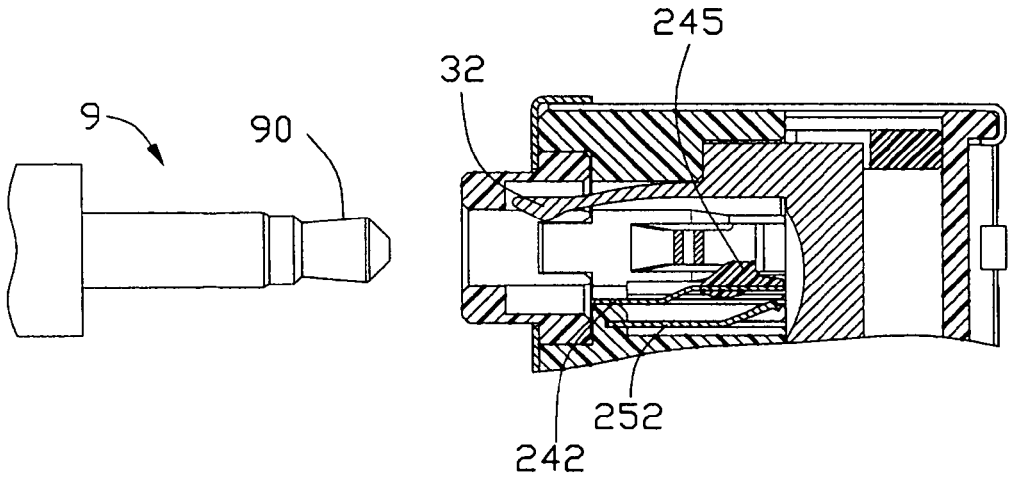
FIG. 7 is a partially cross-sectional view of the electrical connector with the switch in its normally opened condition and a complementary plug before being inserted thereinto.

Referring to FIGS. 7 and 9, the mating plug 9 defines an electric contact section 90.

Referring to FIGS. 1–6, in assembly, the first and the second terminal units 21, 22 of the first terminal group 2 are first assembled to the insulative housing 1 from a rear-to-front direction of the housing 1. Respectively, the signal contacts 23, 26 receive in the receiving spaces 12 and the first slots 13, and the first and second switch contacts 24, 27, 25, 28 receive in the receiving spaces 12 and the second slots 14. The first switch contacts 24, 27 are located above the corresponding second switch contacts 25, 28. The tail portions 263, 274, 284 of the second terminal 22 extend beyond the mounting surface 19 of the housing 1. The grounding contacts 30 of the second terminal group 3 are then assembled to the housing 1 with the arms 32 thereof being respectively received in the third slots 15 and the protrusions 33 thereof being received in the slits 16 of the housing 1. The insert legs 34 of the grounding contacts 30 extend beyond the mounting surface 19 of the housing 1. The mating portions 41 of the four sets of transition contacts 40 of the third terminal group 4 are respectively received in the second slots 14 of the receiving spaces 12 and electrically contact with the tail portions 234, 244, 254 of the first terminal units 21. The terminating portions 42 of the transition contacts 40 extend beyond the mounting surface 19 of the housing 1.

The two retaining blocks 5 is assembled to the insulative housing 1 above the receiving spaces 12*b*, 12*c* with pairs of retaining latches 52 thereof being receiving in corresponding side apertures 17. At the same time, the vertical body strip 31 of the grounding contact 30 is received in the through slits 53 of the retaining blocks 5.

The spacer 6 is assembled to the housing 1 from a bottom of the housing 1. The base 62 of the spacer 6 is received in the recess defined in the mounting surface 19 of the housing 1 and is secured by the pair of latching edges 18. The terminating portions 42 of the transition contacts 40 respectively protrude through the vertical passages 68 of the first and the second steps 65, 64 and extend beyond a bottom surface of the spacer 6. The body strips 31 of the second terminal group 3 are respectively received in the through slots 66 of the spacer 6. The posts 67 of the spacer 16 are respectively received in the holes 55 of corresponding retaining blocks 5. Thus, the retaining blocks 5 and the spacer 6 are assembled to the insulative housing 1 reliably and provide perfect positioning function to the second and the third terminal groups 3, 4.

The mating ports 7 are respectively inserted into the cavities 11 from the first face 10*a* of the housing 1. The projections 71 of each mating port 7 are received in the pair of trapeziform spaces 111, while the cylindrical neck 73 is received in the cylindrical hole 112 of a corresponding cavity 11. The arms 32 of the second terminal group 3 extend into the passageways 72 of the mating ports 7 for providing better grounding effect to the electrical connector. The metal shield 8 is finally assembled to the insulative housing 1 along the front-to-rear direction and encloses the housing 1. The cylindrical necks 73 protrude through corresponding holes 81 and are exposed outside the metal shield 8.

Referring to FIGS. 7 and 8, when the mating plug 9 is not inserted, the first switch contacts 24, 27 do not electrically contact the second switch contacts 25, 28. When the plug 9 is inserted into the receiving space 12 of this stacked electrical connector, the electric mating section 90 push the guiding face 248 of the separator 245 first, so the first spring arm 242 of the first switch contact 24, 27 rotates away from the receiving space 12 and towards the second switch contact 25, 28. As the insertion the mating plug 9 continues, the contact section 90 engages with the mating section 247 of the separator 245, the first spring contact 242 of the first switch contact 24, 27 contacts the projection 255 of the second switch contact 25, 28 and rotates the second spring arm 252 downwardly. At last, the first spring arm 242 contacts with the second spring arm 252 stably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for mounting on a printed circuit board comprising:

an insulative housing comprising a mounting surface for mounting on the printed circuit board, a first face and an opposite second face, and at least one receiving space extending from the second face toward the first face; and at least one terminal unit assembled to the insulative housing and comprising a plurality of signal contacts received in the housing, a first switch contact comprising a first base portion retained in the housing, a first spring arm extending from the first base portion, and an insulative separator disposed on the first spring arm and extending into the receiving space, and a second switch contact comprising a second base portion retained in the housing and a second spring arm extending from the second base portion, wherein the separator is moveable in a plane vertical to the mounting surface, when a mating plug inserts into the receiving space, the separator rotates and drives the first switch contact to connect the second switch contact.

2. The electrical connector as described in claim 1, wherein each switch contact defines a tail portion extending vertically from a bottom edge of the base portion.

3. The electrical connector as described in claim 1, further comprising a metal shield enclosing the insulating housing.

4. The electrical connector as described in claim 1, wherein the first spring arm defines a pair of openings in opposite sides of the free end thereof.

5. The electrical connector as described in claim 4, wherein the separator defines an engaging groove engaging with the openings of the first spring arm.

6. The electrical connector as described in claim 1, wherein the housing defines a plurality of first and second slots communicating with the receiving space to receive the signal contacts and the first and second switch contacts, respectively.

7. The electrical connector as described in claim 6, wherein the first switch contact and the second switch contact are alternately arranged in the housing.

8. The electrical connector as described in claim 1, further comprising a grounding terminal assembled to the insulative housing, the grounding terminal comprising at least one arm extending into the receiving space of the housing and a leg for connecting to the printed circuit board.

9. The electrical connector as described in claim 8, further comprising a plurality of transition terminals assembled to the insulative housing and electrically connecting with the signal contacts and the switch contacts, respectively.

10. The electrical connector as described in claim 1, comprising a first terminal group consisting of a plurality of terminal units.

11. The electrical connector as described in claim 10, wherein the insulating housing comprises a plurality of receiving spaces in an array along a direction vertical to the mounting surface, and wherein the receiving spaces are arranged alternately.

12. The electrical connector as described in claim 11, further comprising a second terminal group assembled to the insulating housing and consisting of a plurality of grounding terminal, each grounding terminal comprising a plurality of arms respectively extending into the receiving spaces of the housing and a leg for connecting to the printed circuit board.

13. The electrical connector as described in claim 12, further comprising a third terminal group consisting of a plurality of sets of transition terminals assembled to the insulating housing and electrically connecting with the terminal units, respectively.

14. The electrical connector as described in claim 13, further comprising a spacer defining a plurality of passages therethrough, and wherein the transition contacts of the third terminal group comprise a plurality of terminating portions extending vertically from the mating portions through the passages.

15. The electrical connector as described in claim 14, further comprising a plurality of retaining blocks respectively engaging with the insulating housing and the spacer to secure the spacer to the housing.

16. The electrical connector as described in claim 11, wherein each cavity of the insulating housing comprises a pair of trapeziform spaces and a cylindrical hole connecting the trapeziform spaces, and wherein each mating port comprises a cylindrical neck received in the cylindrical hole and a pair of projections respectively received in the pair of trapeziform spaces.

17. An electrical connector assembly comprising:

an insulative housing defining a mating face and a receiving space extending therefrom inwardly;

a first switch contact disposed in the housing and defining a first spring arm extending into the receiving space;

a second switch contact disposed in the housing; and an insulative separator mounted only to said first switch contact without direct involvement with the housing, and essentially located in an insertion path of a plug which is adapted to be inserted into the receiving sapce; wherein when said plug is inserted into the receiving space, none of said first switch contact and said second switch contact but said insulative separator is engaged with said plug under a condition that said first switch contact is deflected by said inserted plug to shift an engagement status between said first switch contact and said second switch contact.

18. The electrical connector assembly as described in claim 17, wherein said first switch contact is engaged with the second switch contact when said plug is inserted into the receiving space, and said first switch contact is disengaged from the second switch contact when said plug is removed from the receiving space.

19. The electrical connector assembly as described in claim 17, wherein a grounding terminal is assembled to the housing, said grounding terminal having an arm extending into the receiving space and a leg for connecting to a printed circuit board.

20. An electrical connector assembly comprising:

an insulative housing defining a mating face and a receiving space extending therefrom inwardly;

a first switch contact disposed in the housing;

a second switch contact disposed in the housing; and an insulative separator mounted only to said first switch contact without direct involvement with the housing and essentially located in an insertion path of a plug which is adapted to be inserted into the receiving space; wherein when said plug is inserted into the receiving space, none of said first switch contact and said second contact but said insulative separator is engaged with said plug under a condition that said insulative separator is moved so as to shift an engagement status between said first switch contact and said second switch contact.

21. The electrical connector assembly as described in claim 20, wherein said first switch contact is engaged with the second switch contact when said plug is inserted into the receiving space, and said first switch contact is disengaged from the second switch contact when said plug is removed from the receiving space.

22. The electrical connector assembly as claimed in claim 20, wherein the housing further defines a mounting face, and there are at least two of said receiving spaces extending from the mating face inwardly, said receiving spaces being arranged in an array along a direction vertical to said mounting face.

* * * * *